US007810505B2

(12) United States Patent
Yang

(10) Patent No.: US 7,810,505 B2
(45) Date of Patent: Oct. 12, 2010

(54) METHOD OF OPERATING A CIGARETTE SMOKING SYSTEM

(75) Inventor: Zuyin Yang, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 573 days.

(21) Appl. No.: 11/812,794

(22) Filed: Jun. 21, 2007

(65) Prior Publication Data

US 2007/0256697 A1 Nov. 8, 2007

Related U.S. Application Data

(62) Division of application No. 10/649,790, filed on Aug. 28, 2003, now Pat. No. 7,234,470.

(51) Int. Cl.
*A24F 13/00* (2006.01)

(52) U.S. Cl. ..... 131/194; 131/178

(58) Field of Classification Search ..... 131/329, 131/194, 182, 175, 178, 190; 128/202.21
See application file for complete search history.

(56) References Cited

U.S. PATENT DOCUMENTS

| | | | | |
|---|---|---|---|---|
| 5,060,671 | A | 10/1991 | Counts et al. | |
| 5,388,594 | A | 2/1995 | Counts et al. | |
| 5,499,636 | A | 3/1996 | Baggett, Jr. et al. | |
| 5,505,214 | A | 4/1996 | Collins et al. | |
| 5,591,368 | A | 1/1997 | Fleischhauer et al. | |
| 5,613,505 | A | 3/1997 | Campbell et al. | |
| 5,692,525 | A | 12/1997 | Counts et al. | |
| 5,878,752 | A * | 3/1999 | Adams et al. | 131/329 |
| 6,053,176 | A | 4/2000 | Adams et al. | |

* cited by examiner

*Primary Examiner*—Carlos Lopez
(74) *Attorney, Agent, or Firm*—Buchanan Ingersoll & Rooney PC

(57) ABSTRACT

An electrical smoking system includes a lighter having a plurality of electrical heater elements and a system for electrically actuating the heater elements. The lighter is adapted to receive a cigarette with the heater elements at least partially superposing a portion of the cigarette. The lighter further includes an electromagnet arranged in proximity to magnetic portions of the heater elements, with the electromagnet being actuable to selectively repulse or attract the heater elements.

6 Claims, 8 Drawing Sheets

METHOD OF OPERATING A CIGARETTE SMOKING SYSTEM

CROSS-REFERENCE TO RELATED APPLICATIONS

This application is a divisional application of U.S. application Ser. No. 10/649,790 entitled ELECTROMAGNETIC MECHANISM FOR POSITIONING HEATER BLADES OF AN ELECTRICALLY HEATED CIGARETTE SMOKING SYSTEM, filed on Aug. 28, 2003, now U.S. Pat. No. 7,234,470, the entire content of which is hereby incorporated by reference.

FIELD OF THE INVENTION

The present invention relates to electrical smoking systems, and more particularly an electrical smoking system having adjustably positioned heater blades.

BACKGROUND OF THE INVENTION

Traditional lit-end cigarettes are consumed by lighting an end of a wrapped tobacco rod and drawing air predominantly through the lit end by suction at a mouthpiece end of the cigarette. Traditional cigarettes deliver smoke as a result of combustion, during which a mass of tobacco is combusted at temperatures which often exceed 800° C. during a puff. The heat of combustion releases various gaseous combustion products and distillates from the tobacco. As these gaseous products are drawn through the cigarette, they cool and condense to form a smoke containing the tastes and aromas associated with smoking. Traditional cigarettes produce sidestream smoke during smoldering between puffs. Once lit, they must be fully consumed or be discarded. Relighting a traditional cigarette is possible but is usually an unattractive proposition to a discerning smoker for subjective reasons, such as flavor, taste and odor.

Commonly assigned U.S. Pat. Nos. 5,060,671, 5,388,594 and 5,692,525 disclose electrical smoking systems and methods of manufacturing a cigarette, and are incorporated herein by reference in their entireties. U.S. Pat. No. 5,388,594 describes an electrical smoking system including a novel electrically powered lighter and a novel cigarette that cooperates with the lighter. A plurality of metallic heaters are disposed in a configuration that slidingly receives a tobacco rod portion of the cigarette. The cigarette comprises a tobacco-laden tubular carrier, a cigarette paper overwrapped about the tubular carrier, an arrangement of flow-through filter plugs at a mouthpiece end of the carrier and a filter plug at the free (distal) end of the carrier. The cigarette and the lighter are configured such that when the cigarette is inserted into the lighter, and as individual heaters are actuated for each puff, localized charring occurs at spots about the cigarette in the locality where each heater is bearing against the cigarette (hereinafter referred to as a "heater footprint" or "char zones"). Once all the heaters have been actuated, the cigarette is pulled from contact with the heaters, removed from the lighter and discarded.

SUMMARY OF THE INVENTION

The electrical smoking system according to an embodiment of the invention includes a lighter comprising at least one electrical heater element and a system for electrically actuating the at least one heater element, the lighter being adapted to at least partially receive a cigarette with the at least one heater element partially superposing a portion of the cigarette. At least a portion of the at least one heater element is magnetic, and the lighter further includes an electromagnet arranged in proximity to the magnetic portion of the at least one heater element, with the electromagnet being actuated to selectively repulse or attract the at least one heater element.

DETAILED DESCRIPTION OF THE PREFERRED EMBODIMENTS

Figure 1:
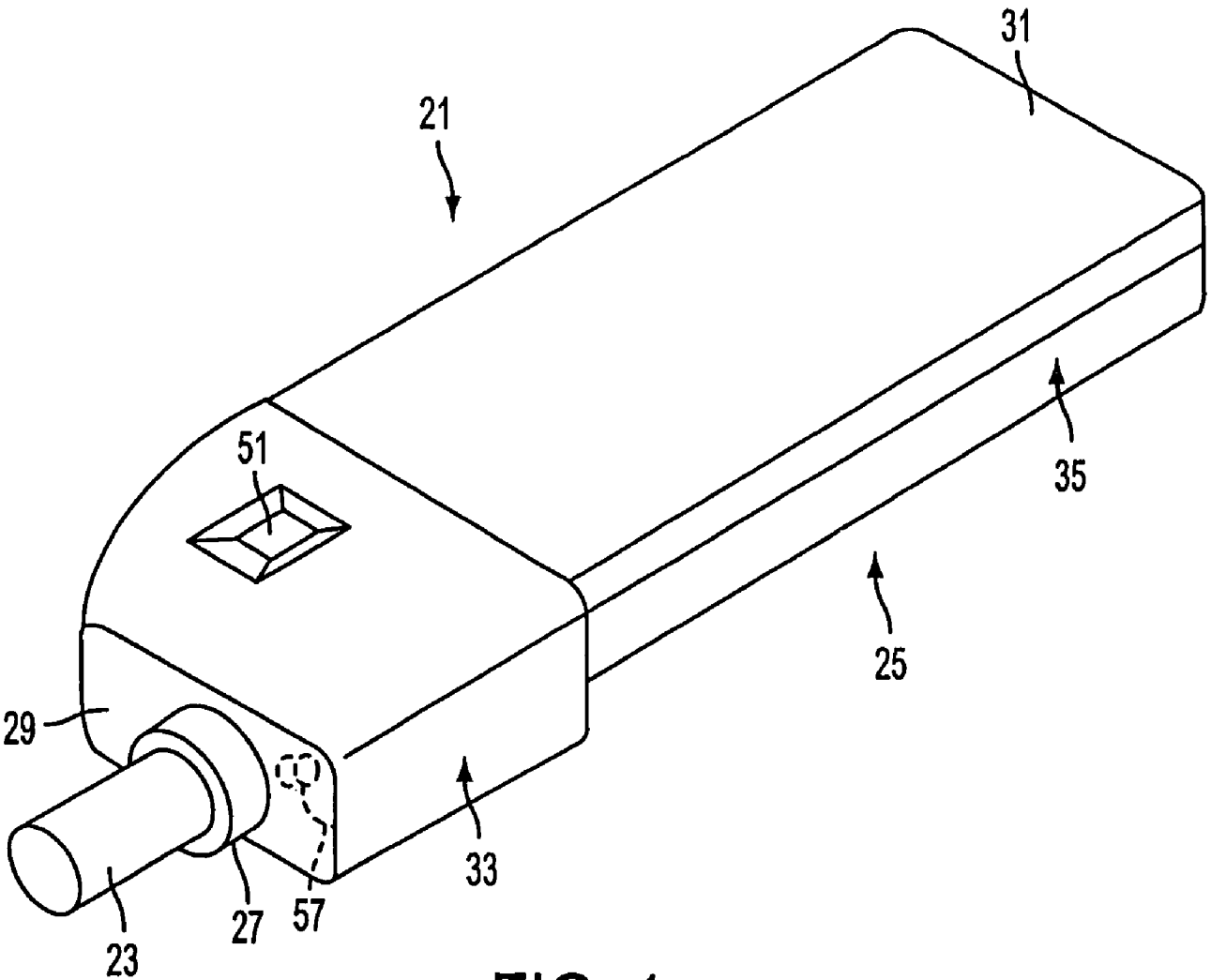
FIG. 1 is a perspective view of a smoking system in accordance with an embodiment of the present invention with a cigarette of the system inserted into the electrically operated lighter.

Referring initially to FIGS. 1, 2, 5A and 5B, an embodiment of the invention provides a smoking system 21 which preferably includes a partially-filled, filter cigarette 23 and a reusable lighter 25. The cigarette 23 is adapted to be inserted into and removed from a cigarette receiver 27 which is open at a front end portion 29 of the lighter 25. Once the cigarette 23 is inserted, the smoking system 21 is used in much the same fashion as a more traditional cigarette, but without lighting or smoldering of the cigarette 23. The cigarette 23 is discarded after one or more puff cycles. Preferably, each cigarette 23 provides a total of eight puffs (puff cycles), or more preferably 10 puffs or puff cycles per smoke. Further particulars of the smoking system are described also in commonly assigned U.S. Pat. Nos. 5,505,214; 5,591,368; and 5,499,636, all of which are hereby incorporated by reference in their entireties.

Figure 2:
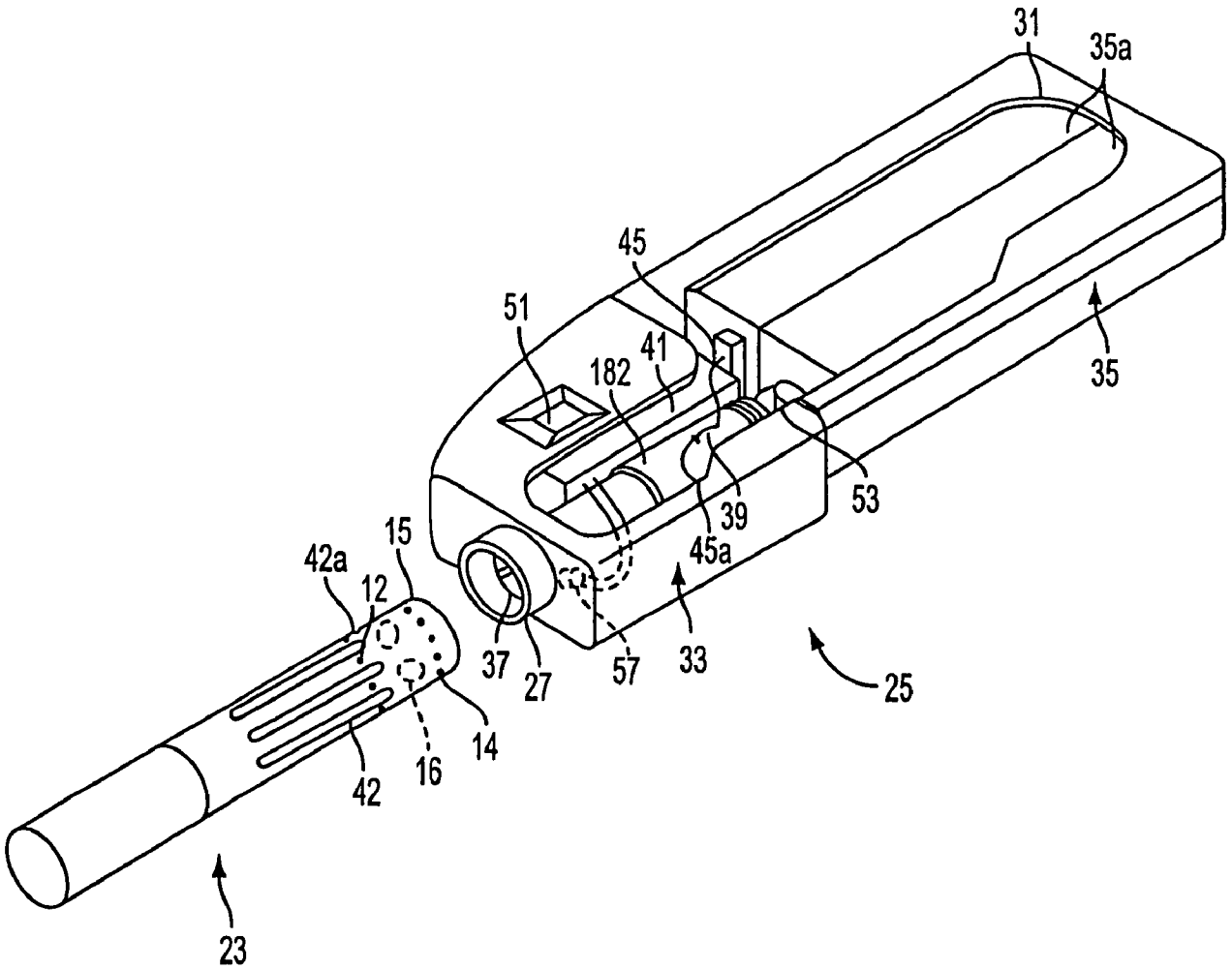
FIG. 2 is a perspective view of the smoking system of FIG. 1, but with the cigarette withdrawn from the lighter upon conclusion of a smoking.
Figure 3A:
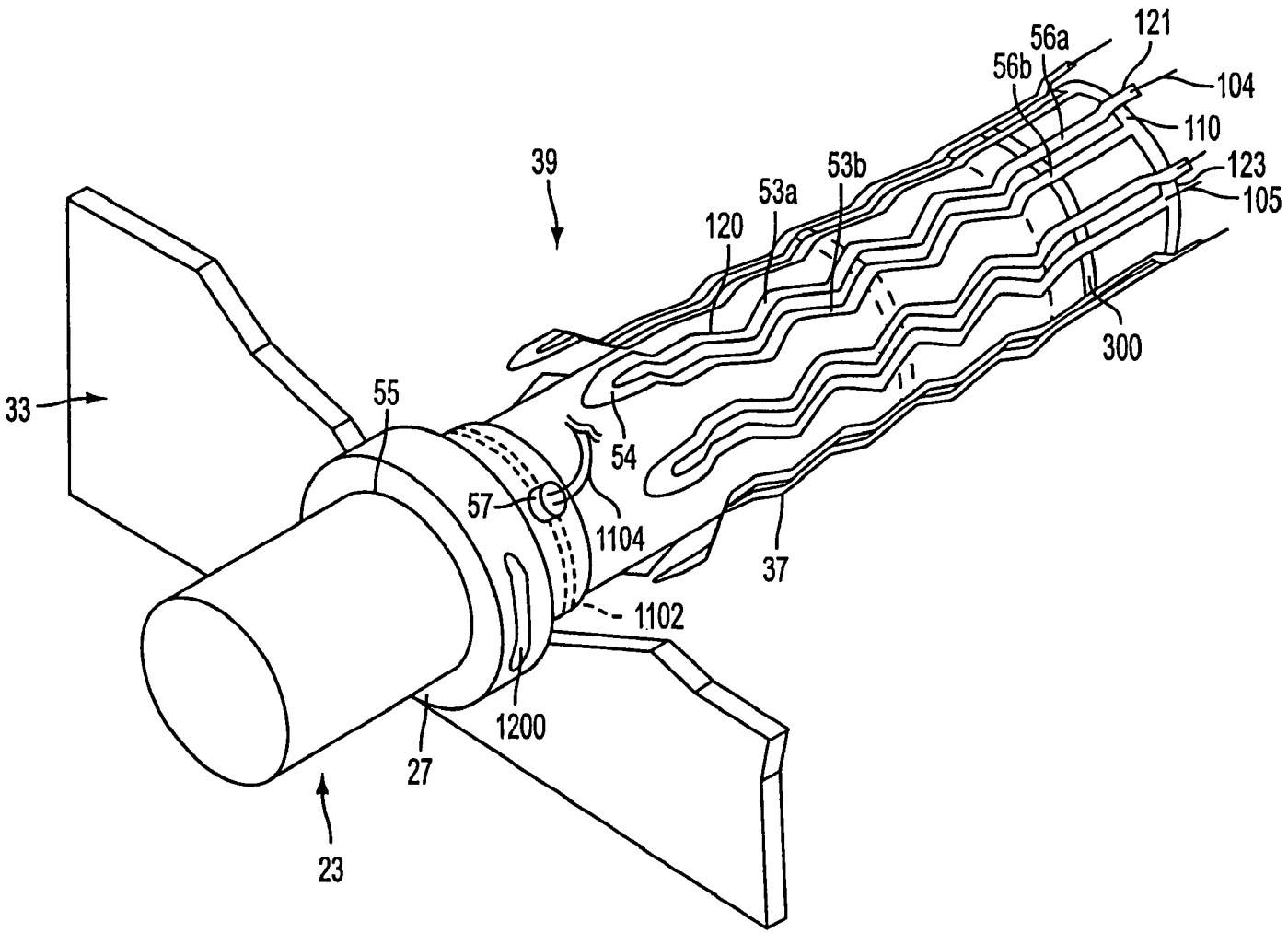
FIG. 3A is a partial perspective detail view of portions of a heater fixture from the smoking system of FIG. 1, including heater elements.
Figure 3B:
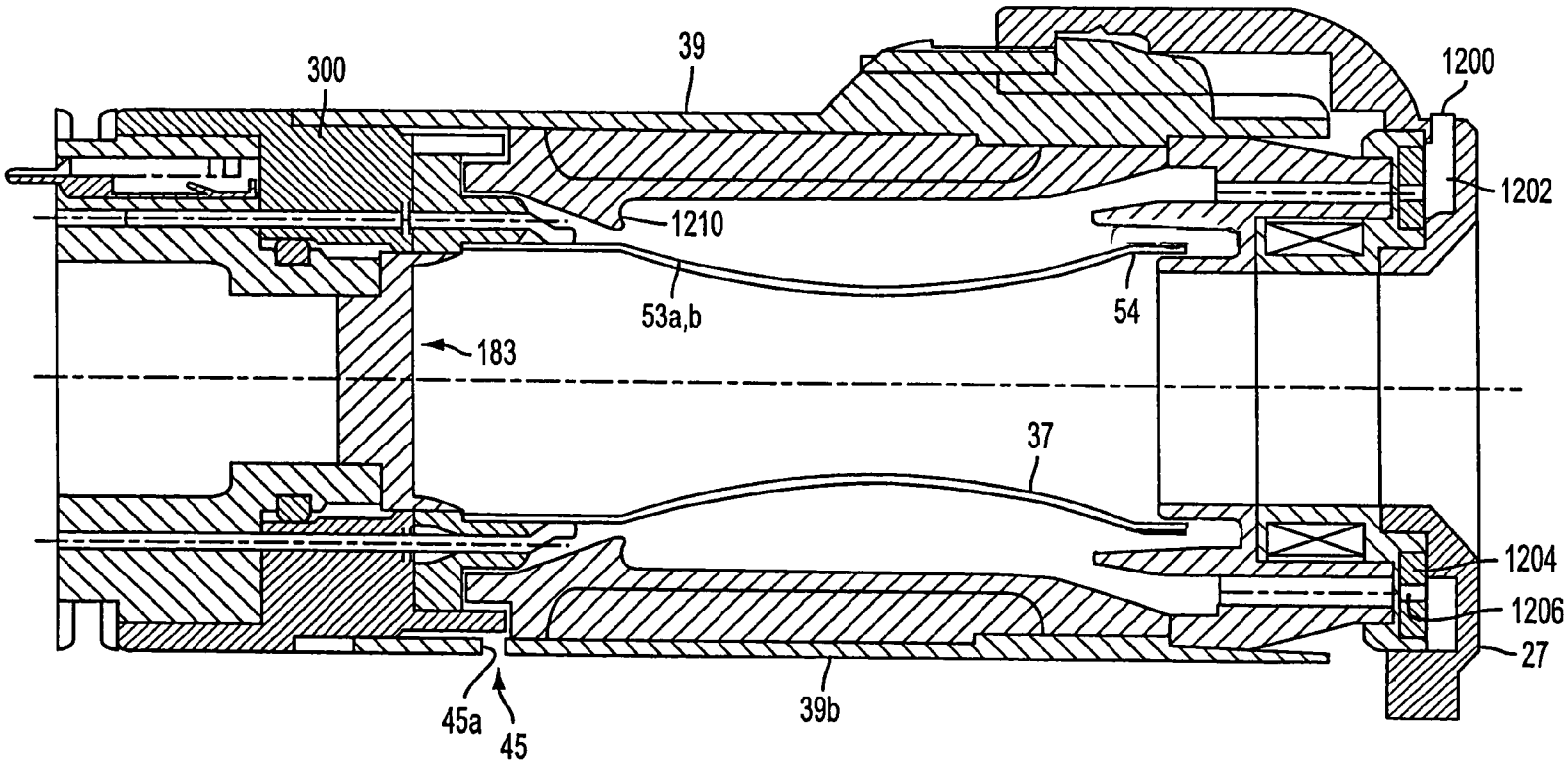
FIG. 3B is a sectional side view of a heater fixture which includes a plurality of heater elements.
Figure 5A:
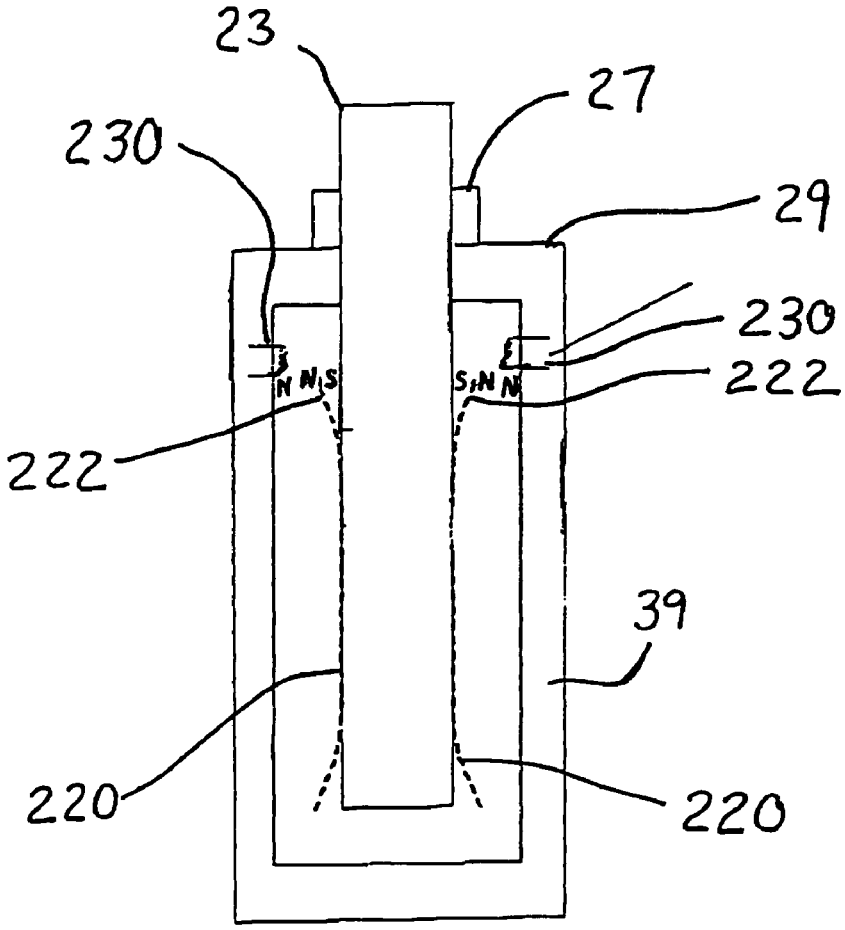
FIG. 5A is a schematic diagram of a heater fixture according to an embodiment of the invention showing the position of the heating blades pushed by electromagnetic forces against an inserted cigarette.
Figure 5B:
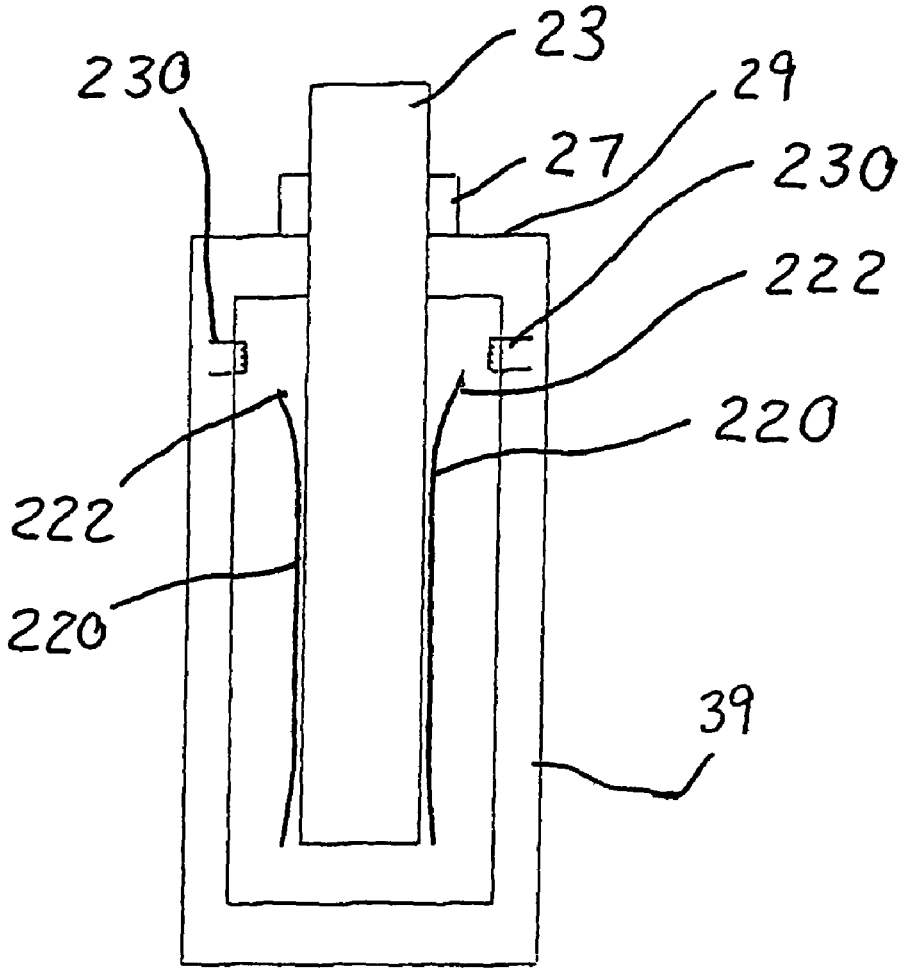
FIG. 5B is a schematic diagram of the heater fixture shown in FIG. 5A, showing the heating blades in a position removed from the cigarette to allow easy insertion and removal of the cigarette from the heater fixture.

The lighter 25 includes a housing 31 having front and rear housing portions 33 and 35. One or more batteries 35*a*, as shown in FIG. 2, are removably located within the rear housing portion 35 and supply energy to a heater fixture 39 which includes a plurality of electrically resistive heating elements, such as the heating elements 37 shown in FIGS. 3A, 3B and 3C, or the heating elements or blades 220 shown schematically in FIGS. 5A and 5B. The heating elements 220 shown in FIGS. 5A and 5B are arranged within the heater fixture 39, within front housing portion 33 of lighter 25 to slidingly receive the cigarette 23 along an intermediate portion of the cigarette receiver 27. A stop 183, such as shown in FIG. 3B located at the base 300 of the heater fixture defines a terminus of the cigarette receiver 27.

A control circuit 41 in the front housing portion 33, such as shown in FIG. 2, selectively establishes electrical communication between the batteries 35*a* and one or more of the heater elements 220 during execution of each puff cycle.

Figure 3C:
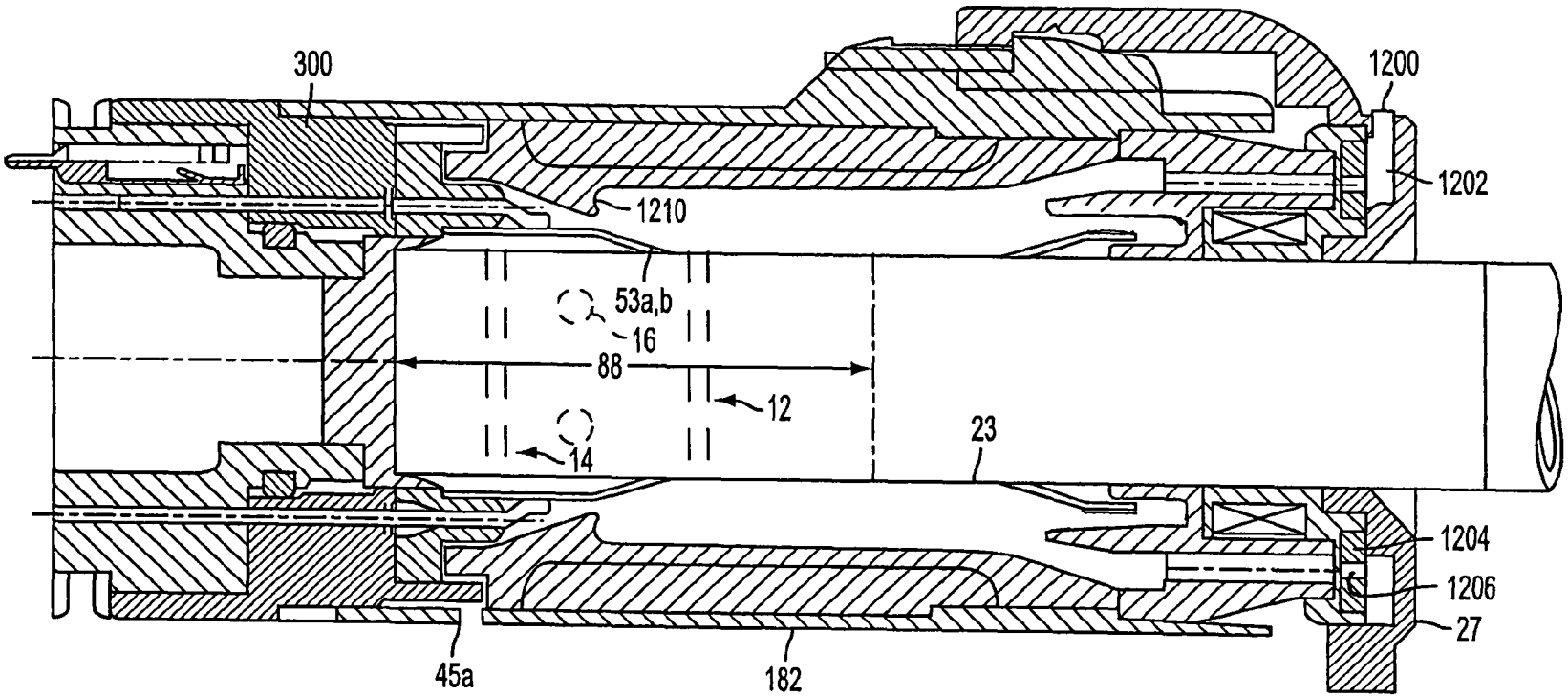
FIG. 3C is a side view of the cigarette shown in FIG. 4 inserted into the heater fixture of FIG. 3B, with the heater fixture shown in cross-section.
Figure 4:
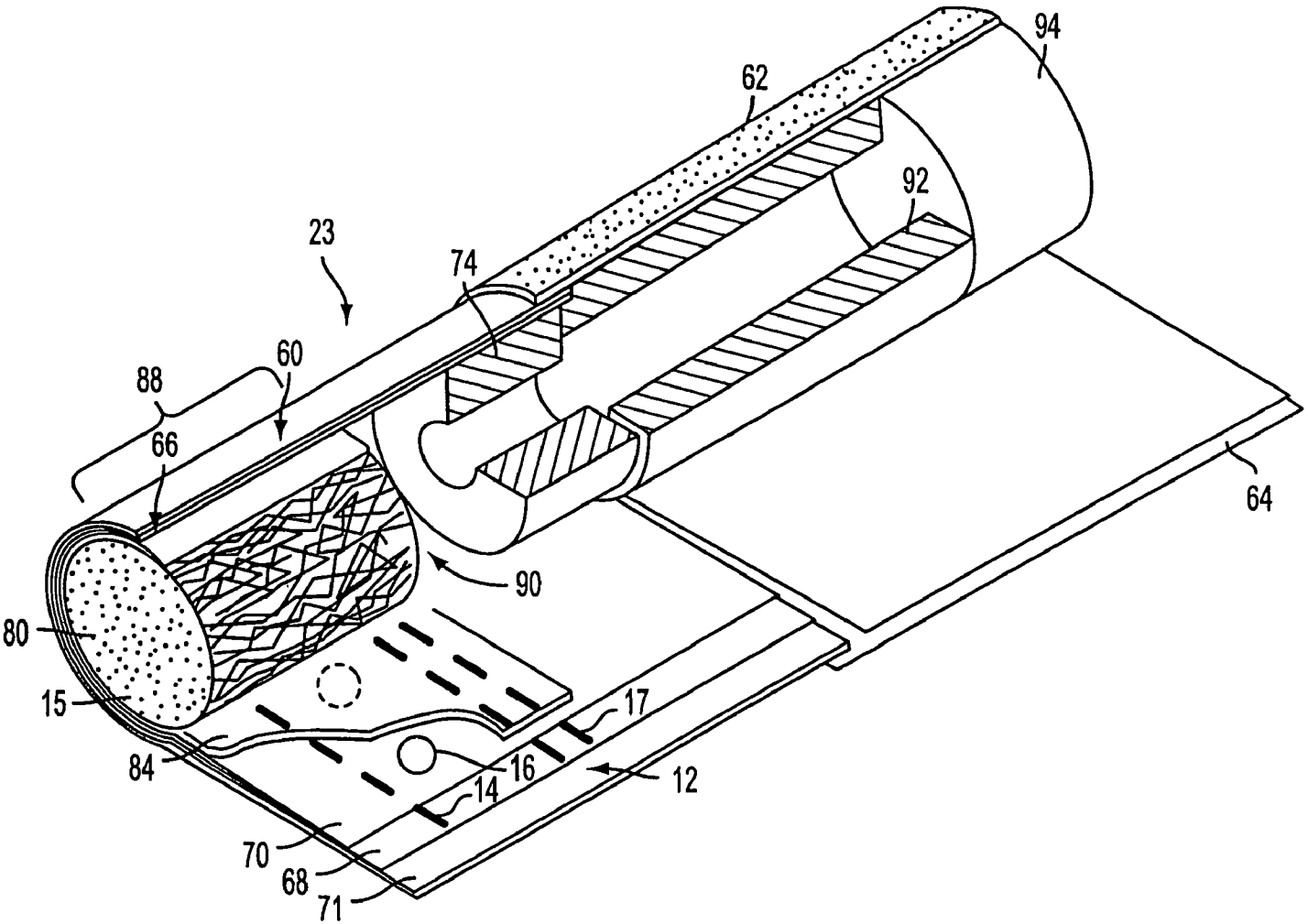
FIG. 4 is a detailed perspective view of an embodiment of the cigarette shown in FIG. 1, with certain components of the cigarette being partially unraveled for illustration.

Circuitry 41, such as shown in FIG. 2, can be activated by a puff-actuated sensor 45 that is sensitive to either changes in pressure or changes in rate of airflow that occur upon initiation of a draw on the cigarette 23 by a smoker. The puff-actuated sensor 45 is preferably located within the front housing portion 33 of the lighter 25 and is communicated with a space inside the heater fixture 39 adjacent the cigarette 23 via a port 45*a* extending through a sidewall portion 182 of the heater fixture 39, as shown in FIGS. 3B and 3C. A puff-actuated sensor 45 suitable for use in the smoking system is described in commonly assigned U.S. Pat. Nos. 5,060,671 and 5,388,594.

An indicator 51 can also be provided at a location along the exterior of the lighter 25, preferably on the front housing portion 33, to indicate the number of puffs remaining in a smoke of a cigarette 23. The indicator 51 displays an image when a cigarette detector 57 detects the presence of a cigarette in the heater fixture. The detector 57 may comprise an inductive coil 1102, shown in FIG. 3A, adjacent the cigarette receiver 27 of the heater fixture and electrical leads 1104 that communicate the coil with an oscillator circuit within the control circuitry 41. To cooperate with the detector 57, the cigarette 23 may include a foil ring or something similar which can affect inductance of the coil winding 1102 such that whenever a cigarette 23 is inserted into the receiver 27, the detector 57 generates a signal to the circuitry 41 indicative of the cigarette being present.

The signals provided to the control circuitry 41 by the puff-actuated sensor 45 and/or the cigarette detector 57 can also control activation of electromagnetic coils 230, shown in FIGS. 5A and 5B, in order to achieve a desired movement of the heater elements 220. As shown in FIG. 5A, at least the distal ends 222 of the heater elements 220 move radially inwardly to bring the heater elements 220 into contact with the cigarette 23. Accordingly, the distal ends 222 of heater elements 220 in FIGS. 5A and 5B, or the distal ends 54 of heater elements 37, as shown in FIG. 3B, are provided with the necessary clearance to allow this movement. As shown in FIGS. 5A and 5B, the heater fixture 39 of the lighter 25 encloses the heater elements 220, which slidingly receive the cigarette 23. The cigarette 23 is supported in a fixed relation to the heater elements 220 such that the heater elements 220 are positioned alongside the cigarette 23 at approximately the same location along each newly inserted cigarette 23. In a preferred embodiment, eight mutually parallel heater elements 220 are disposed concentrically about the axis of symmetry of the cigarette receiver 27. One of ordinary skill in the art will recognize that the number of heater elements 220 is not limited to eight, and may include fewer than eight, or even more preferably include ten heater elements arranged concentrically about the axis of symmetry of the cigarette receiver 27. The locations where each heater element 220 bears against (or is in thermal communication with) a fully inserted cigarette 23 is referred to herein as the heater footprint or char zone 42.

If the heater elements are positioned too close to the center of the heater fixture 39 in a radial direction, the retraction force exerted by the heater elements on an inserted cigarette may be too great to allow removal of a cigarette from the heater fixture without breakage. Furthermore, if the heater elements 220 are too far from the center of the heater fixture in a radial direction, the contact between the heater elements 220 and the inserted cigarette 23 would be inefficient, and would result in insufficient heating of portions along the heater footprint, wasted electrical energy and unsatisfactory smoke delivery. Accordingly, an embodiment of the present invention as shown in FIGS. 5A and 5B provides a method and apparatus for positioning the heater elements 220 inside the heater fixture 39 at a desired position or location so that they exert a small, or very little retraction force when a cigarette is taken out of the heater fixture after consumption. The amount of retraction force required to remove the cigarette 23 can be selected appropriately to avoid breakage of a cigarette that has been weakened as a result of activation of one or more of the heater elements 220 around the circumference of the cigarette 23. The heater elements are preferably shaped such that they press against the outer periphery of a cigarette to provide good contact with the cigarette and thereby ensure efficient heating of the cigarette when activated.

As shown in FIGS. 5A and 5B, the distal ends 222 of the heater elements 220 can be provided with permanent magnets, or otherwise be magnetized with a desired north and south polarity. The heater fixture 39 can be provided with a plurality of electromagnetic coils 230 each of which is positioned in proximity to a respective one of the magnetized distal ends 222 of the heater blades 220 such that activation of the electromagnetic coils 230 generates a repulsive electromagnetic force to push the heater elements 220 against a cigarette 23 inserted into the heater fixture 39. As shown in FIG. 5B, deactivation of the electromagnetic coils 230 removes this repulsive force such that the heater elements 220 can return to their original, pre-biased position. The permanent magnets or magnetized portions at the distal ends 222 of the heater elements 220 have north and south poles that are arranged relative to the north and south poles of the electromagnetic coils 230 such that the activation of the electromagnetic coils 230 creates the repulsive electromagnetic force (i.e. like poles facing each other.)

Although the embodiment shown in FIGS. 5A and 5B provides the heater elements 220 such that they are pre-biased to the position shown in FIG. 5B, which is removed from the inserted cigarette 23, one of ordinary skill in the art will recognize that alternative embodiments could include the heater elements 220 being pre-biased into contact with an inserted cigarette 23, and the arrangement of the polarities of the magnetic portions of the heater elements 220 and the electromagnetic coils 230 providing an attractive force that pulls the heater elements 220 away from the inserted cigarette 23 upon activation of the electromagnetic coils. Another alternative embodiment could include a single, large electromagnetic coil surrounding the heater elements 220 rather than the individual electromagnetic coils 230 shown in FIGS. 5A and 5B. Activation of the electromagnetic coil or coils to either attract or repulse the heater elements 220 can be controlled by the circuitry 41 and signals received from sources such as a puff-actuated sensor 45 or a cigarette detector 57, as discussed above.

In a method according to the present invention wherein the heater elements are moved into close contact with a cigarette during the puff cycles, and then are moved to a position away from the cigarette for either insertion or withdrawal of the cigarette from the heater fixture, cigarette breakage is less likely to occur due to contact between the heater elements and the cigarette. Additional puff cycles may be achieved by the provision of extra heater elements within the heater fixture since even a cigarette that has been weakened by the additional number of char zones can still be removed from the heater fixture without breakage.

It is to be understood that the present invention may be embodied in other specific forms and the process of use may be varied without departing from the spirit or essential characteristics of the present invention. Thus, while the invention has been illustrated and described in accordance with various preferred embodiments, it is recognized that variations and changes may be made therein without departing from the invention as set forth in the claims.

What is claimed is:

1. A method of operating an electrical smoking system including a lighter having an electrical heating element, a system for electrically actuating said heating element, said heating element having at least a portion that is magnetized and an electromagnet being arranged in proximity to said magnetized portion of said heating element, said method comprising:

inserting a cigarette into said lighter to a position wherein said heating element at least partially superposes a portion of the cigarette, detecting the position of the cigarette, generating a signal based upon the detection of the cigarette position, actuating said electromagnet to generate an electromagnetic repulsive force against said magnetized portion of said heating element in response to said signal, monitoring the number of puffs taken on the cigarette after actuation of said electromagnet, and deactivating said electromagnet to remove said repulsive force after a predetermined number of puffs have been monitored, and wherein said repulsive force pushes said heating element into close contact with said portion of the cigarette.

2. The method according to claim 1, further including:

detecting a puff taken on the cigarette, and deactivating said electromagnet to remove said repulsive force after said puff is no longer detected.

3. A method of operating an electrical smoking system including a lighter having an electrical heating element, a system for electrically actuating said heating element, said heating element having at least a portion that is magnetized and an electromagnet being arranged in proximity to said magnetized portion of said heating element, said method comprising:

inserting a cigarette into said lighter to a position wherein said heating element at least partially superposes a portion of the cigarette, detecting a puff taken on said cigarette, generating a signal based upon the puff detection, and actuating said electromagnet to generate an electromagnetic repulsive force against said magnetized portion of said heating element in response to said signal, wherein said repulsive force pushes said heating element into close contact with said portion of said cigarette.

4. The method according to claim 3, wherein a plurality of said heating elements are arranged in circumferentially spaced relation around said portion of said cigarette and said electromagnet extends around the entire circumference of said cigarette such that said repulsive force pushes all of said heating elements into close contact with said portion of said cigarette.

5. The method according to claim 3, wherein said heating element is pre-biased to a position wherein said heating element is positioned out of the path of said cigarette being inserted into said lighter.

6. The method according to claim 4, wherein said heating elements are pre-biased to positions wherein said heating elements are positioned out of the path of said cigarette being inserted into said lighter.

* * * * *